US005144319A

United States Patent [19]

Roberts

[11] Patent Number: 5,144,319

[45] Date of Patent: Sep. 1, 1992

[54] PLANAR SUBSTRATE FERRITE/DIODE PHASE SHIFTER FOR PHASED ARRAY APPLICATIONS

[75] Inventor: Roger G. Roberts, Auburn, Ga.

[73] Assignee: Electromagnetic Sciences, Inc., Norcross, Ga.

[21] Appl. No.: 669,883

[22] Filed: Mar. 14, 1991

[51] Int. Cl.[5] ..... H01Q 3/24; H01P 1/185; H01P 1/195

[52] U.S. Cl. ..... 342/372; 333/24.1; 333/164

[58] Field of Search ..... 333/24.1, 158, 161, 333/164; 342/372

[56] References Cited

U.S. PATENT DOCUMENTS

| | | | |
|---|---|---|---|
| 3,094,676 | 6/1963 | Bowness . | |
| 3,418,605 | 12/1968 | Hair et al. | 333/24.1 |
| 3,454,906 | 7/1969 | Hyltin et al. | 333/164 |
| 3,671,855 | 6/1972 | Bozenic et al. . | |
| 3,736,535 | 5/1973 | Mohr et al. . | |
| 3,947,782 | 3/1976 | Lohn . | |
| 4,010,474 | 3/1977 | Provencher | 343/814 |
| 4,070,639 | 1/1978 | Nemit et al. . | |
| 4,186,357 | 1/1980 | Forterre et al. | 333/24.1 |
| 4,238,745 | 12/1980 | Schwartzmann | 333/164 |
| 4,275,366 | 6/1981 | Schwarzmann | 333/164 X |
| 4,405,907 | 9/1983 | Breese et al. | 333/24.1 |
| 4,467,292 | 8/1984 | Ajioka et al. | 333/24.1 |
| 4,527,134 | 7/1985 | Wantuch | 333/1.1 |
| 4,742,571 | 5/1988 | Letron | 455/327 |
| 4,845,449 | 7/1989 | Stern et al. | 333/258 |
| 4,884,045 | 11/1989 | Alverson et al. | 333/158 |
| 4,931,753 | 6/1990 | Nelson et al. | 333/161 |

OTHER PUBLICATIONS

"A Diode Phase Shifter for Array Antennas", J. F. White, 1964 PTGMTT INTERNATIONAL SYMPOSIUM, May 1964, pp. 181-185.

PIN DIODE DESIGNERS' HANDBOOK AND CATALOG, Unitrode, PD-500B, Nov. 15, 1982, VI. Applications, pp. 99-101.

*Primary Examiner*—Paul Gensler

*Attorney, Agent, or Firm*—Nixon & Vanderhye

[57] ABSTRACT

An RF phase shifter combines a non-reciprocal ferrite 180° stage with one or more reciprocal diode phase shifting stages to produce an essentially planar phase shifter that is ultra small, efficient and lightweight. Such phase shifter elements may be used in phased arrays to produce an array offering major improvements over existing planar substrate all diode phase shifters while maintaining the phase gradient between array elements and without switching the ferrite shifter between the transmit and receive modes.

32 Claims, 2 Drawing Sheets

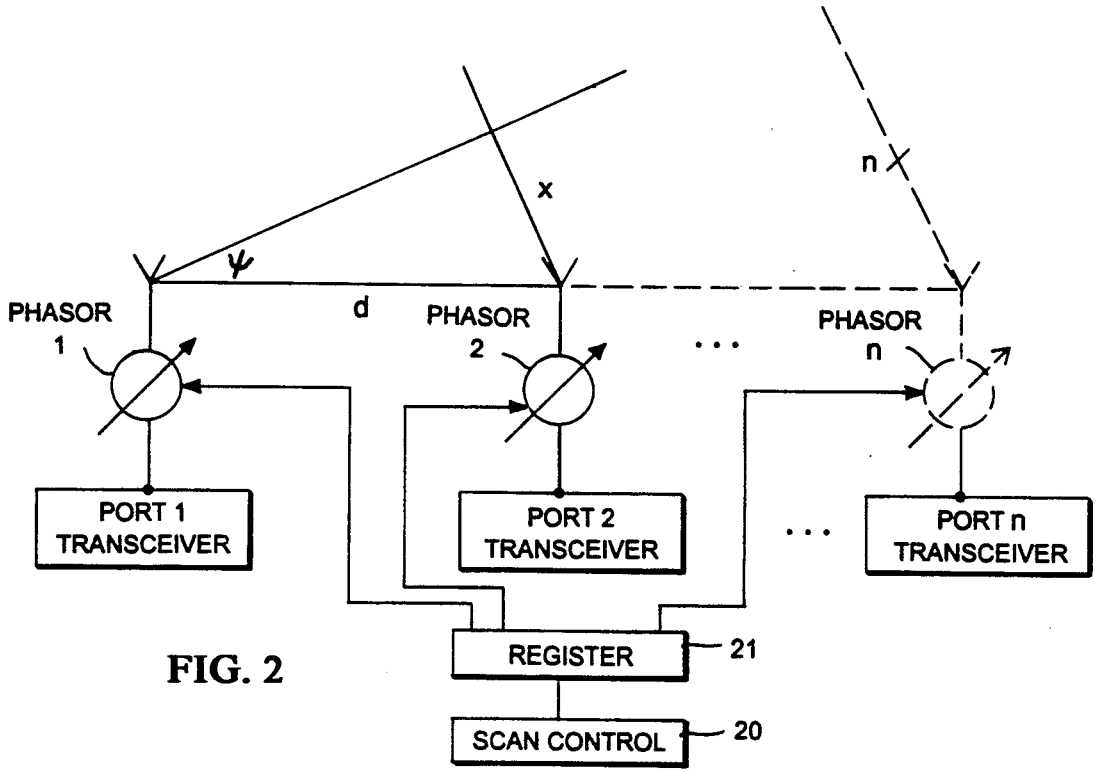
FIG. 2
FIG. 3
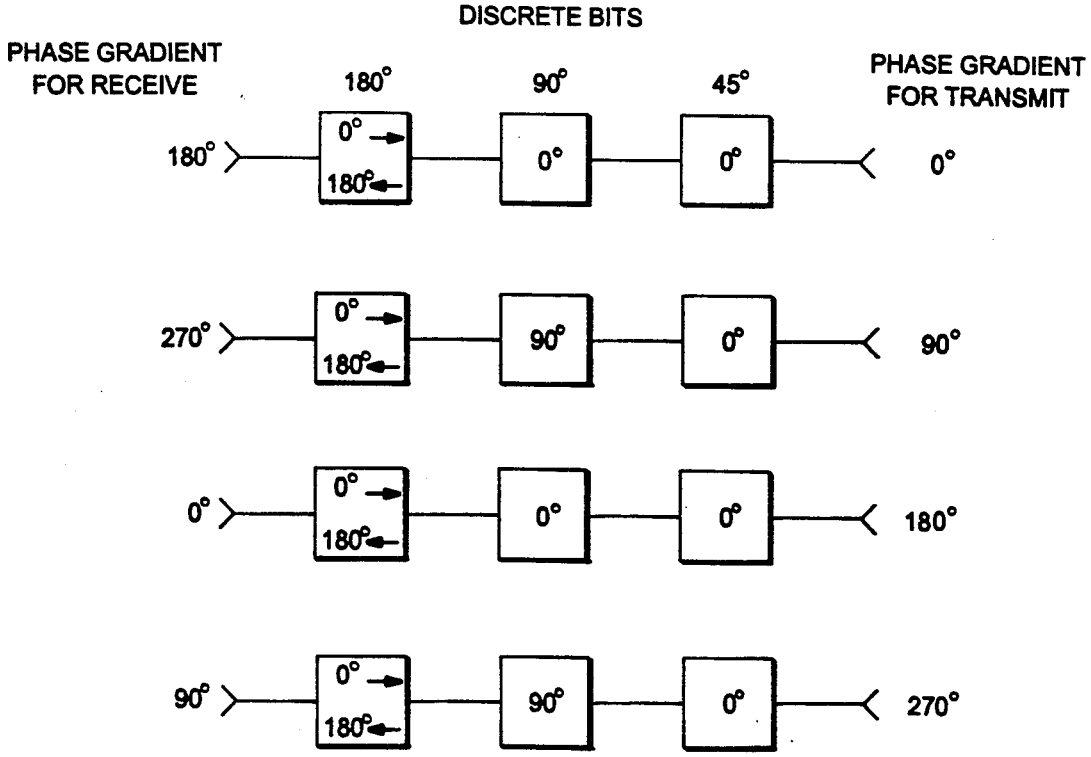

PLANAR SUBSTRATE FERRITE/DIODE PHASE SHIFTER FOR PHASED ARRAY APPLICATIONS

FIELD OF THE INVENTION

The invention pertains to the general field of controllable RF phase shifters and more particularly relates to improved controllable phase shifters for use in planar phased arrays at high RF frequencies in the X- and K-bands. Special utility for the invention is found in radar systems having a high pulse repetition frequency which is necessary to eliminate velocity ambiguity in a moving target indication mode.

RELATED APPLICATIONS This application is related to the following commonly assigned patent applications (the contents of which are hereby incorporated by reference):

Roberts et al Ser. No. 07/330,617, filed Mar. 30, 1989, "Hybrid Mode RF Phase Shifter", now U.S. Pat. No. 5,075,648 issued on Dec. 24, 1991;

Roberts Ser. No. 07/330,638, filed Mar. 30, 1989, "Reciprocal Hybrid Mode RF Circuit for Coupling RF Transceiver to an RF Radiator" now U.S. Pat. No. 5,129,099 ussued on Jul. 7, 1992;

Wallis et al Ser. No. 07/333,961, filed Apr. 6, 1989, "Simplified Driver for Controlled Flux Ferrite Phase Shifter" now U.S. Pat. No. 5,089,716 issued on Feb. 18, 1992;

Rigg Ser. No. 07/353,431, filed May 18, 1989, "Distributed Planar Array Beam Steering Control", now U.S. Pat. No. 4,980,691 issued on Dec. 25, 1990.

BACKGROUND AND SUMMARY OF THE INVENTION

A controllable RF phase shifter should ideally have minimum size, weight, cost and complexity along with low insertion loss, low insertion loss modulation, temperature stability, low drive power requirements and the ability to obtain a desired phase shift in a fast and accurate manner. Although improvements continue to be obtained in the art, still further improvements are required for many applications.

Radar applications having high pulse repetition frequencies in the 200 to 300 kHz range require relatively small high performance controllable reciprocal phase shifters operable in the upper frequency ranges. For example, radar applications involving planar phased arrays for use in aircraft require high performance phase shifters in the X- and K-bands.

Existing planar substrate diode phase shifters may be used in such applications and offer the advantage of being reciprocal between transmit and receive modes, thus eliminating the necessity for switching. The use of reciprocal phase shifters for the above-noted applications is considered a must in most instances due to the aforementioned high pulse repetition frequency required. In this regard if a non-reciprocal phase shifter is used, it must be switched in order to obtain reciprocity between transmit and receive modes which would require the phase shifter to switch at a rate twice the pulse repetition frequency, 400–600 KHz for most airborne moving target indication (MTI) modes. On the other hand, the use of reciprocal phase shifters that are switched only when the beam position for a phased array is changed may require switching at a much lower rate of only about 500 Hz.

In phased array applications of the aforementioned nature insertion loss, insertion loss modulation, RF power, bandwidth, phase accuracy, switching time, switching power and, of course, cost are critical. A waveguide mode twin slab ferrite phase shifter of the nature described in commonly assigned U.S. Pat. No. 4,445,098 to Sharon et al excels in some of these areas. Such twin slab phase shifters, however, are typically mounted in a waveguide housing which is not compatible with microstrip. Accordingly, such phase shifters are relatively large and expensive. Moreover, they are non-reciprocal and if unswitched reciprocity is desirable, these elements must be used in conjunction with circulators, thus further increasing the size.

As may be seen from a review of the above noted copending related application to Roberts et al, Ser. No. 07/330,617, filed Mar. 30, 1989, now U.S. Pat. No. 5,075,648 issued on Dec. 24, 1991, the Sharon et al type of dual toroid ferrite phase shifter may be greatly miniaturized and incorporated serially with a microstrip transmission line to produce a very small, essentially planar phase shifter which excels with respect to most of the above noted critical parameters of a phased shifter for a phase array application. Such hybrid phase shifters, however, are also non-reciprocal.

I have discovered that by properly combining diode and ferrite phase shifter technology a planar substrate ferrite/diode phase shifter for phased array applications is obtainable which offers significant advantages over ferrite technology and major improvements over existing planar substrate diode phase shifter technology.

In a nutshell such advantages may be obtained by using ferrite technology for a 180° controllable phase shifter stage with the remaining controllable phase shifter stages employing diode phase shifters for a composite controllable phase shifter especially usable in a phased array application. Although the ferrite 180° stage is non-reciprocal, the 180° stage does not require switching between transmit and receive modes in a typical phased array application. That is to say, the ferrite 180° stage in phased array applications does not require switching between transmit and receive modes since the 180° offset is of no consequence in many scanning arrays. The remaining stages, however, are required to be reciprocal to avoid switching between modes. Diode technology may be used for these remaining stages since they are inherently reciprocal.

The use of PIN diodes in phase shifting arrangements for use in phased arrays is well known as indicated by: the *PIN Diode Designers' Handbook and Catalog* by Unitrode Corp., Lexington, Mass., pages 99 through 101; and "A Diode Phase Shifter for Array Antennas", by J. F. White, 1964 *PTGMTT International Symposium Program and Digest,* pages 181 through 185.

Exemplary embodiments combining diode and ferrite technology in the manner detailed below offers several significant advantages over an all diode phase shifter. Moreover, such advantages are even more significant at the higher microwave frequencies. For example, the disclosed exemplary embodiment exhibits a lower insertion loss and insertion loss modulation, lower VSWR and VSWR modulation along with higher power handling capability along with lower drive power. Moreover, there are advantages compared to other competing technologies, such as the dual mode reciprocal ferrite phase shifter and the hybrid mode reciprocal ferrite phase shifter (where reciprocity is obtained by pairing two such phase shifters or by switching). Although the advantages are somewhat less in magnitude compared to those pertaining to diode phase shifters, the advantages of my exemplary embodiments are nevertheless significant. For example, distinct advantages are obtained with respect to temperature stability, switching speed and in many applications, lower cost as well.

BRIEF DESCRIPTION OF THE DRAWINGS

These as well as other objects and advantages of my discovery will be better appreciated by careful study of the following detailed description of exemplary embodiments taken in conjunction with the accompanying drawings in which:

FIG. 2 conceptually illustrates a phased array including control elements and parameters of the scan equation for a scan at a given angle ($\psi$), the phase gradient ($\Delta\phi$) and the distance from element to element (d); and FIG. 3 in block diagram format shows an exemplary embodiment of a phased array using the exemplary three-bit planar substrate ferrite/diode phase shifter for each array element—with a 90° phase gradient ($\Delta\phi$) from array element-to-element and a 180° offset between transmit and receive modes.

DETAILED DESCRIPTION OF EXEMPLARY EMBODIMENTS OF THE INVENTION

Figure 1A:
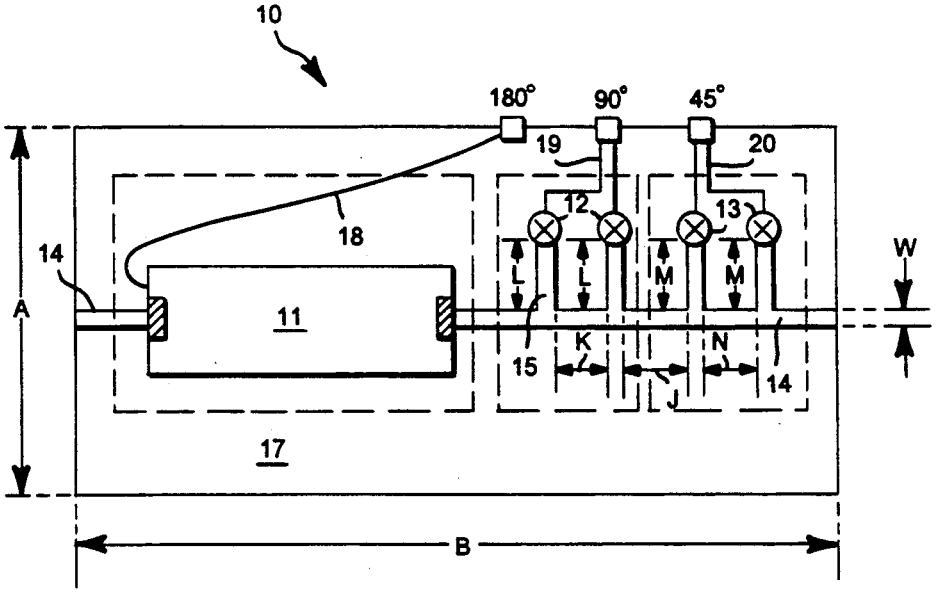
FIG. 1A is a top view of a physical embodiment of a plural bit phase shifter employing a ferrite 180° bit hybrid mode, microstrip compatible phase shifter stage in combination with a 90° bit diode stage and a 45° bit diode stage for an exemplary three-bit phase shifter.
Figure 1B:
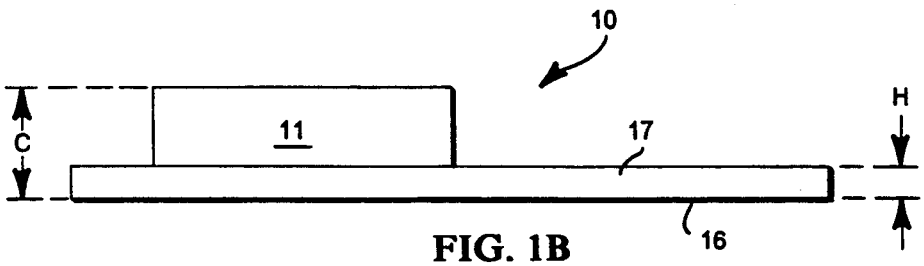
FIG. 1B is a side view of the exemplary three-bit microstrip, compatible ferrite/diode phase shifter of FIG. 1A illustrating the relative placement of elements and dimensions for the exemplary physical embodiment.

In the exemplary embodiment of an improved phase shifter 10, as illustrated in FIGS. 1A and 1B, three discrete phase shifter stages are shown (each controlled by one corresponding bit of a three-bit phase control word) which combine ferrite and diode technologies. The dielectric alumina substrate 17 including a copper with gold flash overlay ground plane 16 includes a non-reciprocal ferrite 180° phase shifter 11 of a nature disclosed in commonly assigned application Serial No. 07/330,617 by Roberts et al. The hybrid phase shifter described therein which has been incorporated by reference may be described as a miniaturized waveguide phase shifter inserted serially between interrupted matched impedance microstrip transmission lines, such as 14, of FIG. 1A herein. The phase shift of this ferrite shifter stage is controlled by the polarity of a current pulse via the 180° bit control terminal illustrated in the figure to which latch wire 18 is connected.

As previously noted, such ferrite phase shifter stages are non-reciprocal. However, for many phased array applications it is unnecessary to switch this bit between transmit and receive modes, thus requiring switching only for beam steering purposes which occurs at a much lower rate than the pulse repetition rates in transceivers.

As may be seen in FIG. 1A, diode phase shifters 12 and 13 are used for the remainder such as a 90° bit stage and a 45° bit stage. In this regard it is to be noted that although the exemplary embodiment is a three-bit phase shifter, the concept works for any number of bits. For example, a fourth 22½ bit stage may be added, as well as additional stages.

Each of the diode stages includes two diodes connected at the end of stubs 15 of microstrip 14. As previously noted, since such diode stages are inherently reciprocal, switching is unnecessary between transmit and receive modes. Additionally, it is to be noted that although the exemplary embodiment illustrates the use of two stubs and diodes for the 90° stage, additional such elements may be added in this stage for increased bandwidth.

Figure 1C:
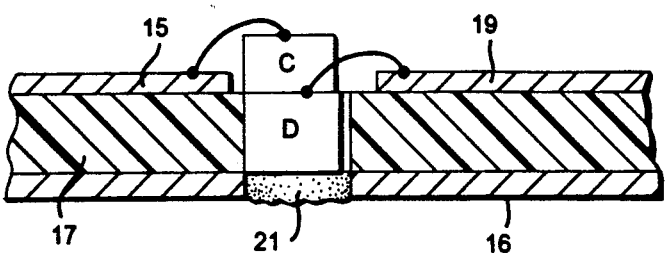
FIG. 1C is a partial sectional view showing the manner in which a semiconductor diode and capacitor may be incorporated and connected in the phase shifting arrangement of FIG. 1A.
Figure 1D:
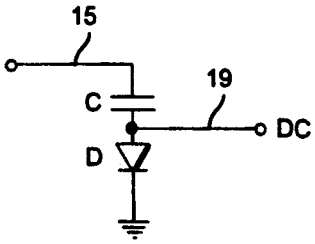
FIG. 1D is a schematic illustration of the elements of FIG. 1C.

As may be seen from a consideration of FIGS. 1C and 1D, the diode stages 12 and 13 can be implemented using encapsulated capacitors in series with PIN diodes inserted through openings in the substrate 17 and connected between an appropriate loaded microstrip transmission line segment and the ground plane 16 by way of a soldered or brazed connection 21, for example. A bit control line 19, for example, may be connected to a pair of such diodes with their blocking capacitors connected to the loaded stubs 15, as illustrated in FIG. 1C (which has an equivalent circuit as shown in FIG. 1D). Similar connections are made for each of the diode shifter stages.

In the presently preferred embodiment the alumina substrate 17 has a relative dielectric constant of about 9 and a thickness H of 0.025 inches. Ground plane 16 is preferably copper with gold flashing and may typically range from 100 microinches to 0.001 inch. Moreover, the width W of the microstrip in this exemplary embodiment is such that with the above noted dielectric constant and thickness, the microstrip has a characteristic transmission line impedance of 50 ohms. Additionally, although the lengths L and M of stubs 12 and 13, respectively, may vary somewhat with the capacitor size (approximately 10 picofarad) in order to obtain the appropriate susceptance for a desired phase shift for each stage, in most instances such stub lengths will be slightly less than ¼ wavelength ($\lambda/4$).

Additional exemplary dimensions for the presently preferred embodiment include dimensions J, K and N which are less than but approximately equal to $\lambda/4$ and with J also preferably being dimensioned to be larger than the width W of the microstrip 14 (to avoid undesirable interstage coupling). Still further exemplary dimensions include the width A of the phase shifter element 10 being approximately 0.2 inches, a length B of about 0.6 inch and an overall height C of approximately 0.100 inches. The above dimensions are typical for a phasor operating in the X-band frequency range.

FIG. 2 conceptually illustrates a phased array and its computer control as well as parameters of the scan equation for a given angle $\psi$, a selected phase gradient $\Delta\phi$ and the distance d between array elements (1, 2,—n). Scan control device 20, as aforementioned, may include a conventional computer system for supplying suitable phase control bits to each array element register 21, which in turn supplies the control bits to each of the phase shifter stages to obtain a desired scan angle for the array, as well as maintaining a desired phase gradient $\Delta\phi$ (which is the change in relative radiated phase from antenna array element to array element).

As may be seen from FIG. 2 the sine of $\psi$ is x/d and $x = d \sin \psi$ where x is the path difference from aperture 1 to aperture 2 when constructive interference occurs.

$\psi$ is the scan angle and d is the element to element spacing. Additionally, the phase gradient $\Delta\phi$ is obtained by converting x to electrical length.

$$\Delta\phi = 2\pi x/\lambda,$$

then $$\Delta\phi = 2\pi/\lambda d \sin \psi.$$

Since each controllable phaser of FIG. 2 corresponds to a controllable phase shifter of the nature illustrated in FIG. 1A, for example, it may be seen that with the appropriate binary control inputs to each element, a desired scan angle and phase gradient may be obtained for the RF at radiator ports 1 to n.

It is important to maintain the phase gradient from element to element of a phased array during both transmit and receive times for a given scan direction. As aforementioned, although any number of control bits may be implemented, as shown in FIG. 3 a three-bit controllable phase shifter has been selected for the exemplary array. Each of the phase shifter stages incorporates a ferrite hybrid mode 180° stage along with a diode 90° stage and a 45° stage, with the control bits of the non-reciprocal ferrite stage and the reciprocal diode stages selected for the illustrated example so as to obtain a 90° phase gradient or element to element phase difference. As will be noted, the selected 90° phase gradient is obtained on transmit and receive without switching the non-reciprocal ferrite 180° bit. As will be further noted from a consideration of the FIG. 3, the only difference between transmit and receive is a 180° offset which is of no consequence for many phase scanning array applications.

The disclosed exemplary embodiment of FIG. 1A as used in phased array applications represents a major improvement over existing planar substrate all diode phase shifters, as well as obtaining distinct advantages, albeit somewhat less significant advantages, over dual mode reciprocal ferrite phase shifters and hybrid mode reciprocal ferrite phase shifters.

When compared to an all diode phase shifter arrangement, for example, the disclosed exemplary embodiment will have a lower insertion loss and insertion loss modulation, lower VSWR and VSWR modulation, higher power handling capability, lower drive power requirements and possibly lower cost. Such advantages are obtained since in an all diode phase shifter the 180° stage has the highest loss and loss modulation, as well as the highest VSWR and VSWR modulation. Moreover, since the diodes on the 180° stage are most often directly coupled to the line, the 180° stage has the lowest power handling capability.

As to competing technologies involving dual mode reciprocal ferrite phase shifters or hybrid mode reciprocal ferrite phase shifters, the advantages are less pronounced since both have lower insertion loss and insertion loss modulation. However, the exemplary embodiments of my invention nevertheless offer significant advantages over these phase shifters as to temperature stability, switching speed and, depending on the application, lower cost as well.

Accordingly, with continued interest in planar phased arrays for aircraft radar and the like, a low cost, high performance phase shifter for the X- and K-bands may be obtained by combining both ferrite and diode technology in the manner described with respect to the illustrated exemplary embodiments.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A radio frequency phase shifter for controllably shifting the phase of RF signals by selected amounts comprising:
   - a non-reciprocal ferrite phase shifting stage for selectively providing a first increment of phase shift greater than 90°;
   - at least one reciprocal semiconductor phase shifting stage serially connected to said ferrite stage for selectively providing at least a second increment of phase shift smaller than said first increment,
   - whereby said RF signals are shifted in phase by an amount dependent on the cumulative phase shifts provided by said stages.

2. A radio frequency phase shifter as in claim 1 wherein said first increment shift is 180° and said phase shifter includes at least two reciprocal semiconductor phase shifting stages each of which provides a different increment of phase shift up to 90°.

3. A radio frequency phase shifter as in claim 2 wherein a first of said at least two semiconductor stages provides a 90° phase shift, and
   - a second of said at least two semiconductor stages provides a 45° phase shift.

4. A radio frequency phase shifter as in claim 1 further including:
   - a dielectric substrate;
   - a microstrip RF circuit having first and second ends and being located on said substrate,
   - said microstrip circuit including said ferrite phase shifting stage connected serially therein.

5. A radio frequency phase shifter as in claim 4 wherein said microstrip circuit includes a plurality of controllably loaded microstrip stubs and each said semiconductor stage includes at least one said stub.

6. A radio frequency phase shifter as in claim 5 wherein each said semiconductor stage includes at least one diode switch.

7. A radio frequency phase shifter as in claim 5 wherein:
   - each said semiconductor stage includes at least one PIN diode serially connected with a capacitor;
   - said substrate includes openings at the ends of said microstrip stubs, and
   - said PIN diodes and capacitors are connected between their respective stub ends and a ground plane conductor on the opposite side of said substrate via said openings.

8. An RF phase shifting arrangement for use in a phased array, said arrangement comprising:
   - an RF transceiver;
   - an RF antenna element;
   - a dielectric substrate;
   - a microstrip RF circuit with first and second ends and being located on said substrate, said first end connected to said transceiver and said second end connected to said antenna element;

a first non-reciprocal ferrite phase shifter stage serially connected in said microstrip for selectively providing an increment of phase shift greater than 90°;

a second reciprocal semiconductor phase shifter stage serially connected to said microstrip for selectively providing an increment of phase shift; and control means for controlling each phase shifter stage to selectively provide incremental amounts of phase shift to the RF signals passing between said transceiver and said antenna element.

9. An RF phase shifting arrangement as in claim 8 further including:

at least a third reciprocal semiconductor stage serially connected to said microstrip for selectively providing at least a third incremental amount of phase shift.

10. An RF phase shifting arrangement as in claim 9 wherein each reciprocal phase shifter stage includes at least one PIN diode connected to said microstrip by a microstrip stub,.

11. An RF phase shifting arrangement as in claim 9 wherein said increment of phase shift selectively applied by said non-reciprocal ferrite stage is 180°.

12. An RF phase shifting arrangement as in claim 9 wherein said increments of phase shift selectively applied by said reciprocal stages are increments up to 90°.

13. An RF phase shifting arrangement as in claim 12 wherein said increment of phase shift provided by said second reciprocal semiconductor stage is 90° and said increment of phase shift selectively provided by said third reciprocal semiconductor stage is 45°.

14. An RF phase shifting arrangement as in claim 10 wherein said substrate includes openings at the ends of said stubs, and said PIN diodes are located in said openings.

15. An RF phase shifting arrangement as in claim 10 wherein each said reciprocal phase shifter stage includes two stubs spaced from each other by about one quarter of a wavelength.

16. An RF phase shifting arrangement as in claim 10 wherein each said reciprocal phase shifter stage includes two stubs and said stubs are less than but approximately equal to one quarter of a wavelength.

17. An RF phase shifting arrangement as in claim 8 wherein said substrate has a relative dielectric constant of nine and the thickness of said substrate and the width of said microstrip are selected such that the microstrip has a resistance characteristic of fifty ohms.

18. In a phased array wherein the phase of the RF signals of each element is controllably shifted, each said element comprising:

a non-reciprocal ferrite phase shifting stage for selectively providing a 180° phase shift;

at least one reciprocal semiconductor phase shifting stage connected to said ferrite stage for selectively providing an increment of phase shift up to 90°, whereby said RF signals of each element are shifted in phase by an amount dependent on the cumulative selected phase shifts provided by each said stage.

19. In a phased array as in claim 18 in which each phase shifter element includes at least two reciprocal semiconductor phase shifting stages wherein each said reciprocal phase shifting stage provides a different increment of phase shift up to 90°.

20. In a phased array as in claim 19 further including:

a control means for supplying control signals to each stage of each said phase shifter element for selectively providing increments of phase shift at each said stage;

whereby a selected scan angle and phase gradient for the array are obtained.

21. In a phased array as in claim 19 wherein a first of said two reciprocal semiconductor stages selectively provides a 90° phase shift and a second of said semiconductor stages selectively provides a 45° phase shift.

22. In a phased array as in claim 19 wherein each phase shifting element further includes:

a dielectric substrate;

a microstrip RF circuit having first and second ends and being located on said substrate;

said microstrip including said ferrite phase shifting stage connected serially therein.

23. In a phased array as in claim 22 wherein said microstrip circuit includes a plurality of microstrip stubs and each said semiconductor stage includes at least one stub.

24. In a phased array as in claim 23 wherein:

each said semiconductor stage includes at least one PIN diode;

said substrate includes openings at the ends of said microstrip stubs; and said PIN diodes are located in said openings.

25. A planar substrate RF phase shifter comprising:

a planar dielectric substrate having a conductive coating on one side and a microstrip RF transmission line circuit on the other side;

a non-reciprocal controllable 180° RF ferrite phase shifter connected serially with said microstrip RF transmission line circuit;

a reciprocal controllable 90° RF diode phase shifter connected serially with said microstrip RF transmission line circuit; and a reciprocal controllable 45° RF diode phase shifter connected serially with said microstrip RF transmission line circuit.

26. A planar substrate RF phase shifter as in claim 25 further comprising:

three control bit circuits also disposed on said other side of the substrate and connected to provide independent control signals to each of said phase shifters.

27. In a radio frequency phase shifter the method of controllably shifting the phase of RF signals by selected amounts, said method comprising:

selectively providing a first increment of phase shift greater than 90° with a controllable non-reciprocal ferrite phase shifting stage;

selectively providing at least one additional increment of phase shift smaller than said first increment with at least one controllable reciprocal semiconductor phase shifting stage, and controlling said stages to selectively provide said increments, whereby said RF signals are shifted in phase by an amount dependent on the cumulative selected phase shifts provided by said stages.

28. A method as in claim 27 wherein said first increment of phase shift is 180° and at least two of said additional increments of phase shift up to 90° are controllably provided.

29. A method as in claim 28 wherein said at least two additional increments of phase shift are 90° and 45°, respectively.

30. In a phased array, the method of controllably shifting the phase of the RF signals of each array element, said method comprising:

providing a non-reciprocal controllable ferrite phase shifting stage in each said array element, wherein each said ferrite stage is capable of selectively producing a 180° phase shift;

providing at least one controllable reciprocal semiconductor phase shifting stage in series with each said ferrite stage wherein each said semiconductor phase shifting stage is capable of selectively producing an increment of phase shift up to 90°, and controlling each stage of each said array whereby said RF signals of each said element are shifted in phase by an amount dependent on the cumulative selected phase shifts provided by each said stage.

31. A method as in claim 30 further comprising:

providing at least two controllable reciprocal semiconductor stages in each said array element wherein each said semiconductor stage is capable of providing an increment of phase shift up to 90°.

32. A method as in claim 31 wherein said semiconductor stage increments are 90° and 45°, respectively.

* * * * *